US010820129B1

(12) United States Patent
Kronlachner

(10) Patent No.: US 10,820,129 B1
(45) Date of Patent: Oct. 27, 2020

(54) SYSTEM AND METHOD FOR PERFORMING AUTOMATIC SWEET SPOT CALIBRATION FOR BEAMFORMING LOUDSPEAKERS

(71) Applicant: Harman International Industries, Incorporated, Stamford, CT (US)

(72) Inventor: Matthias Kronlachner, Encino, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/541,838

(22) Filed: Aug. 15, 2019

(51) Int. Cl.
*H04R 29/00* (2006.01)
*H04R 3/04* (2006.01)
*H04S 7/00* (2006.01)

(52) U.S. Cl.
CPC ..... *H04R 29/002* (2013.01); *H04R 3/04* (2013.01); *H04S 7/301* (2013.01); *H04R 2205/024* (2013.01); *H04R 2430/23* (2013.01)

(58) Field of Classification Search
CPC ..... H04R 29/002; H04R 29/001; H04R 3/04; H04R 3/12; H04R 2430/23; H04R 2205/024; H04R 2430/20; H04R 2203/12; H04S 7/303; H04S 7/301; H04S 7/302
See application file for complete search history.

(56) References Cited

U.S. PATENT DOCUMENTS

2005/0152557 A1* 7/2005 Sasaki ..... H04S 7/302 381/58
2006/0093128 A1* 5/2006 Oxford ..... H04M 9/082 379/406.01
2010/0135118 A1* 6/2010 Van Leest ..... H04S 7/301 367/124
2010/0195444 A1* 8/2010 Choisel ..... H04R 5/02 367/127
2011/0091055 A1* 4/2011 LeBlanc ..... H04S 7/301 381/303
2014/0003635 A1* 1/2014 Mohammad ..... G10K 11/16 381/306
2018/0242097 A1* 8/2018 Kriegel ..... H04S 3/008

* cited by examiner

*Primary Examiner* — Yogeshkumar Patel
(74) *Attorney, Agent, or Firm* — Brooks Kushman P.C.

(57) ABSTRACT

A system including an audio source configured to transmit a first stimulus signal to one of a first beamforming loudspeaker assembly and a second beamforming loudspeaker assembly to play back an audio output and to receive the audio output from the one of the first beamforming loudspeaker assembly and the second beamforming loudspeaker assembly. The audio source is configured to determine a first distance between a first beamforming loudspeaker assembly and a second beamforming loudspeaker assembly and to determine a second distance between the audio source and the first beamforming loudspeaker assembly. The audio source is configured to determine a third distance between the audio source and the second beamforming loudspeaker assembly and to determine a location for transmitting the audio output from each of the first beamforming loudspeaker assembly and the second beamforming loudspeaker assembly based at least on the first distance, the second distance, and the third distance.

18 Claims, 8 Drawing Sheets

SYSTEM AND METHOD FOR PERFORMING AUTOMATIC SWEET SPOT CALIBRATION FOR BEAMFORMING LOUDSPEAKERS

TECHNICAL FIELD

Aspects disclosed herein generally relate to a system and method for performing automatic sweet spot calibration for beamforming loudspeakers. These aspects and others will be discussed in more detail herein.

BACKGROUND

U.S. Publication No. 2018/0242097 to Kriegel et al. provides an audio receiver that receives one or more input audio signals representing one or more channels of a sound content and applies a first beam pattern to the input audio signals to generate a first set of beam-formed audio signals. The audio receiver determines a second beam pattern that is less directional than the first beam pattern. The audio receiver determines that driving of a loudspeaker array using the first set of beam-formed audio signals will cause one or more transducers of the loudspeaker array to operate beyond an operational threshold. In response, the audio receiver applies the second beam pattern to the input audio signals to generate a second set of beam-formed audio signals. The audio receiver drives the loudspeaker array using the second set of beam-formed audio signals.

SUMMARY

In at least one embodiment, a system for determining a location for a beamforming loudspeaker system to transmit an audio output thereto is provided. The system includes a memory device and an audio source including the memory device. The audio source is configured to transmit a first stimulus signal to one of a first beamforming loudspeaker assembly and a second beamforming loudspeaker assembly to play back an audio output and to receive the audio output from the one of the first beamforming loudspeaker assembly and the second beamforming loudspeaker assembly. The audio source is further configured to determine a first distance between a first beamforming loudspeaker assembly and a second beamforming loudspeaker assembly and to determine a second distance between the audio source and the first beamforming loudspeaker assembly. The audio source is further configured to determine a third distance between the audio source and the second beamforming loudspeaker assembly and determine a location for transmitting the audio output from each of the first beamforming loudspeaker assembly and the second beamforming loudspeaker assembly based at least on the first distance, the second distance, and the third distance.

In at least another embodiment, a computer-program product embodied in a non-transitory computer readable medium that is programmed to determine a location for a beamforming loudspeaker system to transmit an audio output thereto is provided. The computer-program product comprising instructions to transmit a first stimulus signal to one of a first beamforming loudspeaker assembly and a second beamforming loudspeaker assembly to play back an audio output and to receive the audio output from the one of the first beamforming loudspeaker assembly and the second beamforming loudspeaker assembly. The computer-program product comprises instructions to determine a first distance between a first beamforming loudspeaker assembly and a second beamforming loudspeaker assembly and to determine a second distance between the audio source and the first beamforming loudspeaker assembly. The computer-program product comprises instructions to determine a third distance between the audio source and the second beamforming loudspeaker assembly and to determine a location for transmitting the audio output from each of the first beamforming loudspeaker assembly and the second beamforming loudspeaker assembly based at least on the first distance, the second distance, and the third distance.

In at least another embodiment, a method for determining a location for a beamforming loudspeaker system to transmit an audio output thereto is provided. The method includes receiving an audio output from one a first beamforming loudspeaker assembly and a second beamforming loudspeaker assembly. The method further includes determining a first distance between the first beamforming loudspeaker assembly and a second beamforming loudspeaker assembly and determining a second distance between the audio source and the first beamforming loudspeaker assembly. The method further includes determining a third distance between the audio source and the second beamforming loudspeaker assembly; and determining a location for transmitting the audio output from each of the first beamforming loudspeaker assembly and the second beamforming loudspeaker assembly based at least on the first distance, the second distance, and the third distance. The location corresponds to a position in which the audio output from the first beamforming loudspeaker assembly and the second beamforming loudspeaker assembly is perceived by a listener as having a similar loudness and acoustic delay.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is recognized that the controllers as disclosed herein may include various microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof), and software which co-act with one another to perform operation(s) disclosed herein. In addition, such controllers as disclosed utilizes one or more microprocessors to execute a computer-program that is embodied in a non-transitory computer readable medium that is programmed to perform any number of the functions as disclosed. Further, the controller(s) as provided herein includes a housing and the various number of microprocessors, integrated circuits, and memory devices ((e.g., FLASH, random access memory (RAM), read only memory (ROM), electrically programmable read only memory (EPROM), electrically erasable programmable read only memory (EEPROM)) positioned within the housing. The controller(s) as disclosed also include hardware-based inputs and outputs for receiving and transmitting data, respectively from and to other hardware-based devices as discussed herein.

Figure 1:
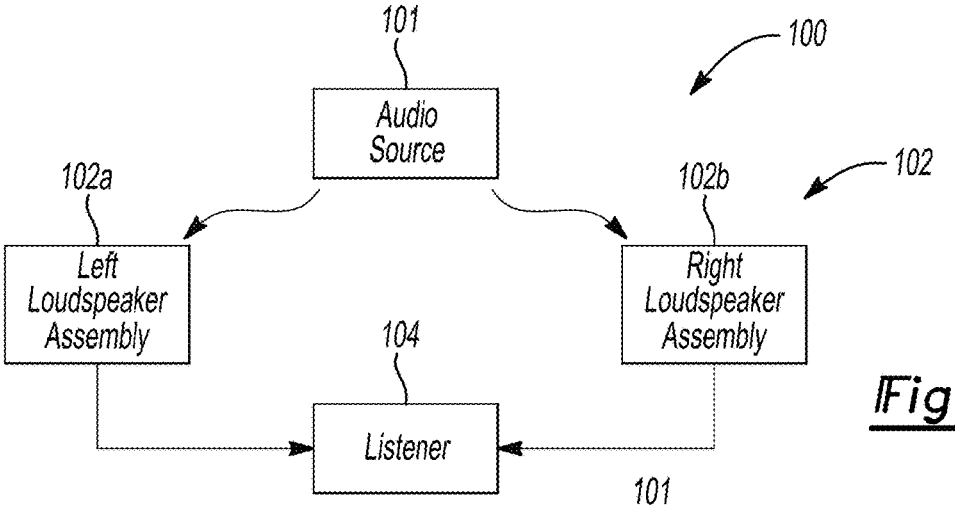
FIG. 1 generally depicts one example of an audio playback system that provides a sweet spot listening experience for a listener.

FIG. 1 generally depicts one example of an audio playback system 100 including an apparatus 101 and a beamforming loudspeaker system 102 that achieves a sweet spot for a listener 104. The apparatus 101 may be, for example, an audio source (hereafter 101) that provides an audio input signal to the loudspeaker system 102. It is recognized that the audio source 101 may be a mobile device, laptop, tablet or other suitable variant thereof. The audio source 101 may wirelessly (or via hardwire connection) transmit the audio input signal to the loudspeaker system 102. The loudspeaker system 102 plays back the audio input signal for the listener 104. The loudspeaker system 102 generally includes a left beamforming loudspeaker assembly (hereafter "left loudspeaker assembly) 102*a* and a right beamforming loudspeaker assembly (hereafter "right loudspeaker assembly) 102*b*. It is recognized however that the loudspeaker system 102 may include any number of loudspeaker assemblies that plays back the audio input signal for the listener 104. The left and right loudspeaker assemblies 102*a*, 102*b* may be implemented as beamforming loudspeakers and each assembly 102*a*, 102*b* includes an array of loudspeakers. In one example, each beamforming loudspeaker assembly may include an array of loudspeakers that includes a total of thirty-three speaker drivers. For example, the thirty-three speaker drivers may include, for example, twelve –¾" (19 mm) tweeters, sixteen –2" (50 mm) Mid-range speakers, four –5.25" (50 mm) woofers, and one –10" (250 mm) integrated subwoofer. In this case, such a beamforming loudspeaker assembly may be implemented, for example, as a Lexicon SL-1™ loudspeaker assembly. It is recognized the number and size of the tweeters, mid-range speakers, woofers and subwoofers may change based on the desired criteria of a particular implementation.

Each array of loudspeakers in a given loudspeaker assembly 102*a*, 102*b* is capable of being controlled by a number of digital sound processors (DSPs) (not shown). In one example, the DSP may utilize a finite impulse response (FIR) filter and various signal processing algorithms to control the audio output from the assembly 102*a*, 102*b*. For example, the DSP may control a phase (or angle) and volume of the audio signal that is being output from the loudspeaker assembly 102*a*, 102*b* to achieve high directivity of the audio output to the intended target (or intended listener 104). In general, the DSP may be positioned within each loudspeaker assembly 102*a*, 102*b* and generally receives a stimulus signal from the audio source 101. The stimulus signal will be discussed in more detail below. The DSPs receive the audio input signal from the audio source 101 and controls the beamforming operation to playback the audio input signal as an audio output for the listener 104.

In the example illustrated in FIG. 1, the left and right loudspeaker assemblies 102*a*, 102*b* provide a listening sweet spot for the listener 104. For example, a sweet spot may generally be defined as the left and right loudspeaker assemblies 102*a*, 102*b* providing the same loudness and time of flight (e.g., delay) of the audio output to the listener 104. Alternatively, the audio output from the left and right loudspeaker assemblies 102*a*, 102*b* reach the listener 104 at the same time and at the same level.

Figure 2:
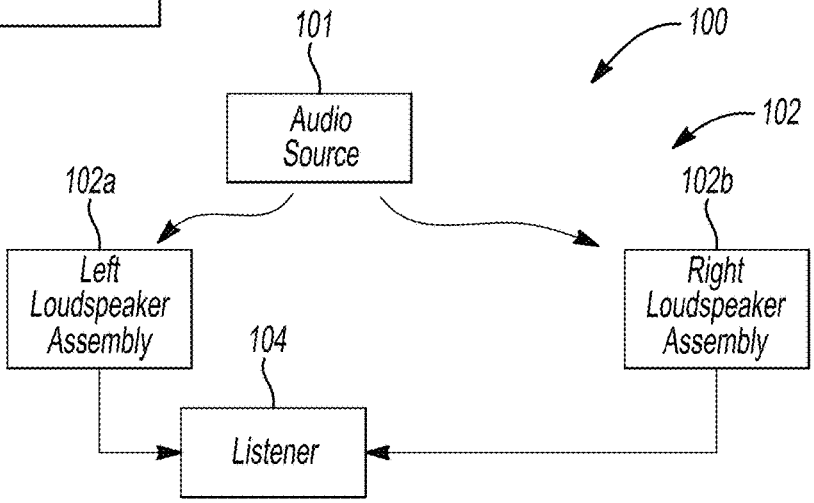
FIG. 2 generally depicts one example of an audio system that provides a dynamic sweet spot listening experience for a listener in accordance to one embodiment.

FIG. 2 generally depicts one example of the system 100 in connection with a dynamic sweet spot in accordance to one embodiment. In comparison to FIG. 1, FIG. 2 illustrates that the distance between the audio source 101 and the left loudspeaker assembly 102*a* is different that the distance between the audio source 101 and the right loudspeaker assembly 102*b*. However, the system 10 may be calibrated to control the audio output such that the audio output is reached at the left loudspeaker assembly 102*a* and the right loudspeaker assembly 102*b* at the same time and at the same level.

Without sweet spot calibration, it can be seen that the audio source 101 provides the audio output to the left loudspeaker assembly 102*a* before the audio output is received by the right loudspeaker assembly 102*b* since the left loudspeaker assembly 102*a* is closer to the audio source 101 than the right loudspeaker assembly 102*b*. To account for the difference in distance between the audio source 101 and the left loudspeaker assembly 102*a* and the distance between the audio source 101 and the right loudspeaker assembly 102*b*, the system 100 is calibrated such that the audio source 101 changes a delay and gain of the audio as transmitted thereform to the closest loudspeaker assembly (i.e., the left loudspeaker assembly 102*a*). In this case, the audio source 101 may employ a longer delay for the transmission of the audio output to the left loudspeaker assembly 102*a* as opposed to any delay that is applied to the transmission of the audio output to the right loudspeaker assembly 102*b*.

For example, the audio source 101 may be calibrated to ensure that audio, as transmitted thereform, is received at the same time for both the left loudspeaker assembly 102*a* and the right loudspeaker assembly 102*b*, and that the audio as transmitted from the audio source 101 is delivered at the same amplitude at the left loudspeaker assembly 102*a* and the right loudspeaker assembly 102*b*. The left and the right loudspeaker assembly 102*a* and 102*b* may then focus the audio beam (or direct the audio beam) toward the listener 104 as part of the beamforming functionality provided by these devices.

Figure 3:
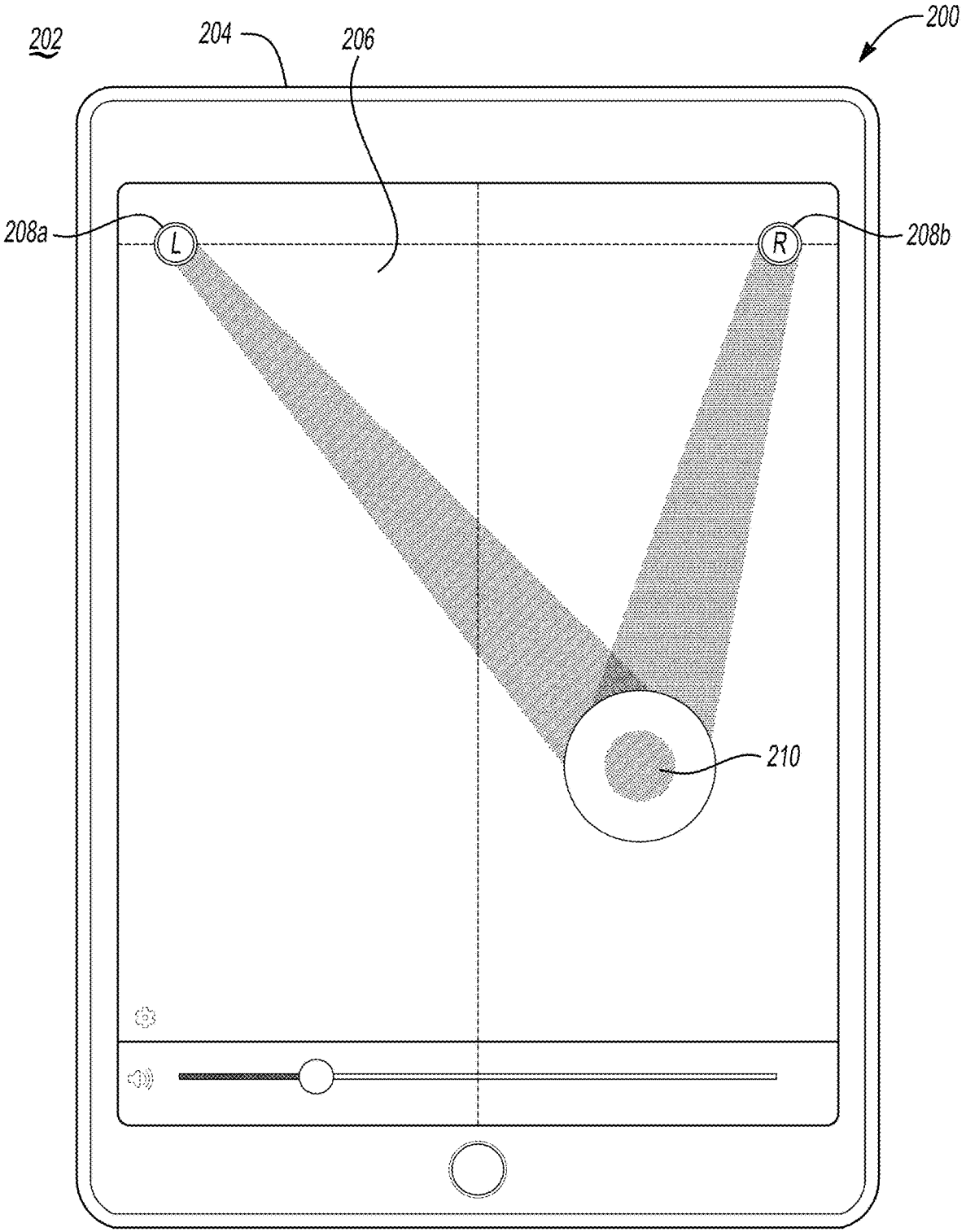
FIG. 3 generally depicts one example for calibrating a loudspeaker system to an audio source for achieving a sweet spot.

FIG. 3 generally depicts one example of an audio system 200 that calibrates a loudspeaker system 202 for achieving a sweet spot for a listener. For example, the system 200 includes an audio source 204 that may be in the form of a tablet having a built-in microphone (not shown). The audio source 204 includes a user interface 206 that enables a user to specify a distance for each speaker as generally shown on a display of the user interface 206 (e.g., see reference elements 208*a* and 208*b* which correspond to visual indicators of a left loudspeaker assembly and a right loudspeaker assembly, respectively) in relation to a visual indicator of the audio source 204 (e.g., see reference element 210) on the user interface 206. The audio source 204 stores information corresponding to the distance settings as entered by the user and adjusts the delay of the transmission of the audio signal to the loudspeaker system 200 accordingly.

Figure 4:
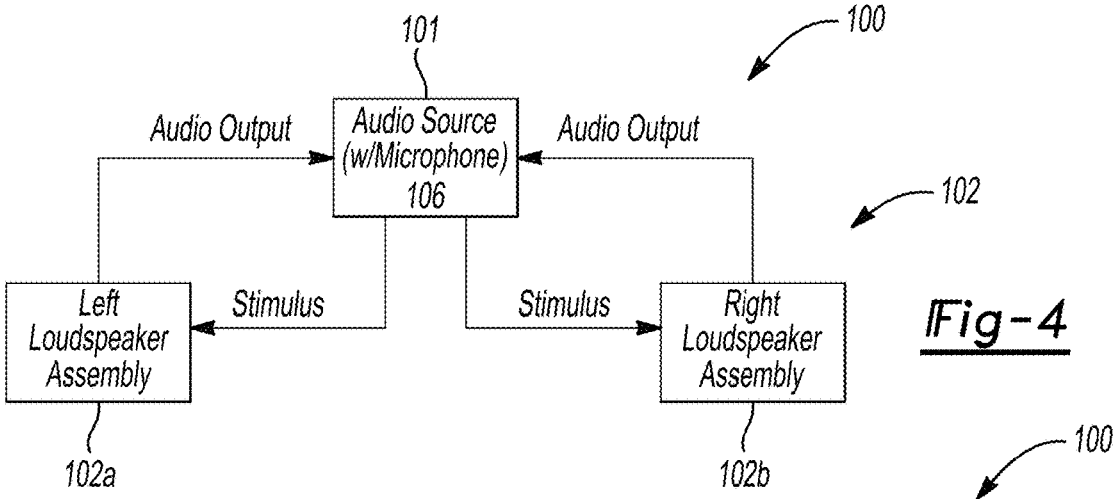
FIG. 4 generally depicts the audio system performing a sweet spot calibration for a beamforming loudspeaker system in accordance to one embodiment.

FIG. 4 generally depicts the audio system 100 performing a sweet spot calibration for a beamforming loudspeaker system in accordance to one embodiment. The audio source 101 is generally equipped with at least one microphone 106 (hereafter "microphone 106") to perform the calibration. In general, the audio source 101 may wirelessly transmit a stimulus signal to the left and the right loudspeaker assemblies 102*a*, 102*b* to play back audio. In response to the receiving the stimulus signal, the left and the right loudspeaker assemblies 102*a*, 102*b* transmit the audio output. It is recognized that the stimulus signal is not audible.

The microphone 106 captures the audio output provided from the left and the right loudspeaker assemblies 102*a*, 102*b*. In general, a stable round trip latency may be required from the transmission of the stimulus signal, to the receipt and playback of the audio output, and finally for the recording of the audio output on the microphone 106. For example, a jitter associated with round-trip latency must be stable and the jitter must be between +/−145 microseconds which generally equals 7 samples of audio data on the audio output @ 48 kHz This may ensure that the audio source 101 is capable of ascertaining the distance of each of the left loudspeaker assembly 102*a* and the right loudspeaker assembly 102*b* therefrom within +/−5 cm. The aspects required to perform the sweet spot calibration will be discussed in more detail below.

Figure 5:
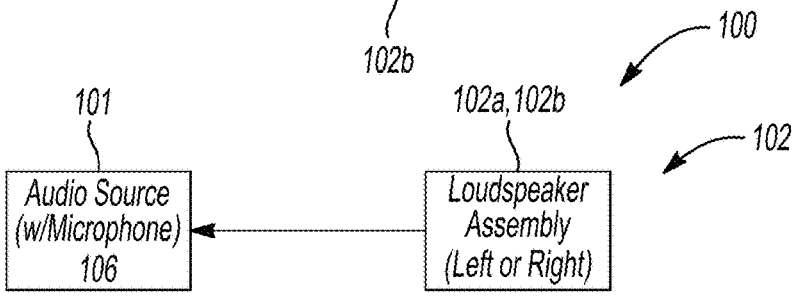
FIG. 5 generally depicts a first aspect that is performed by the audio system to perform the sweet spot calibration for the beamforming loudspeaker system in accordance to one embodiment.

FIG. 5 generally depicts a first aspect that is performed by the system 100 to perform the sweet spot calibration for the beamforming loudspeaker system 102 in accordance to one embodiment. In the first aspect, the audio source 101 determines the distance between the loudspeaker assemblies 102*a*, 102*b* after a first stimulus signal is sent. In general, a user may place the audio source 101 proximate to the left or right loudspeaker assemblies 102*a*, 102*b*. In one example, the user may place the audio source 101 within 5 cm of the left or right loudspeaker assemblies 102*a*, 102*b*. In addition, the user may activate the left or the right loudspeaker assembly 102*a*, 102*b* to transmit the audio output to the audio source 101 as an omnidirectional beam as opposed to a directional beam (or beamforming beam with a predetermined directivity) in response to the stimulus signal.

Figure 6:
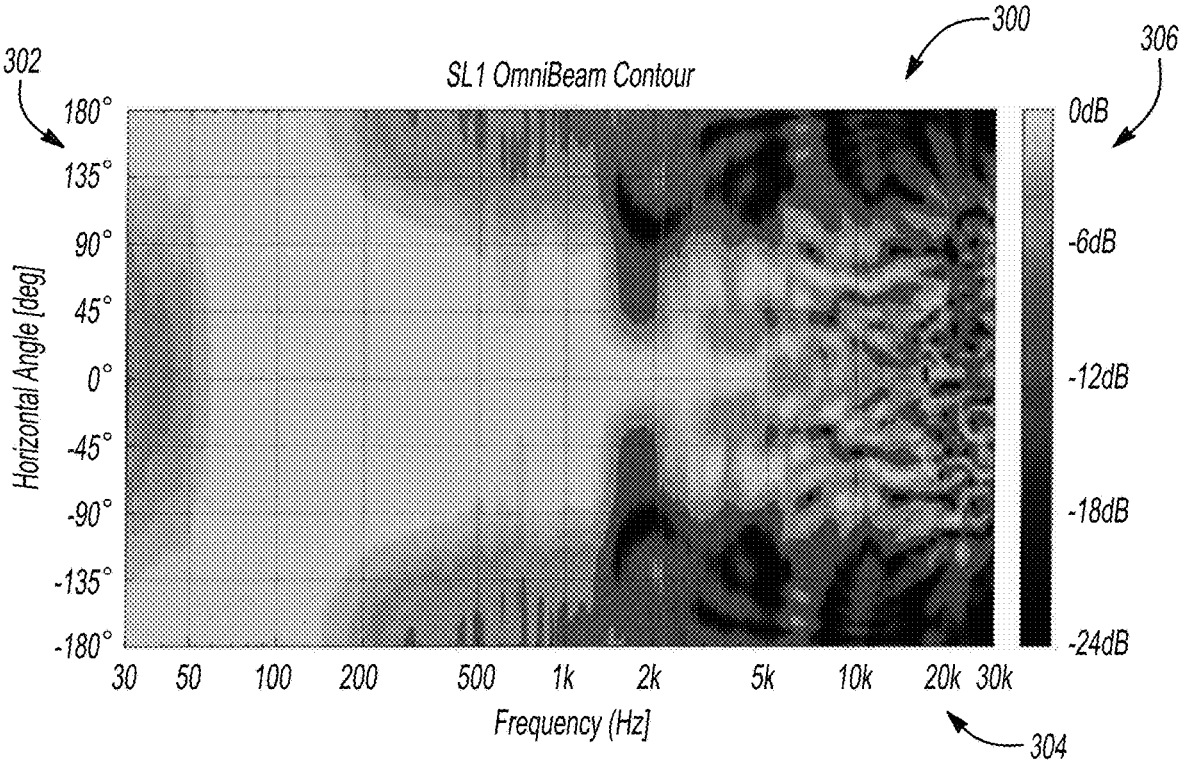
FIG. 6 generally depicts a signal contour for an audio output of a left or right beamforming loudspeaker in connection with the first aspect as set forth in FIG. 5.

In this case, the left or right loudspeaker assemblies 102*a*, 102*b* transmit the audio output with a large horizontal angle that spans from −180 degrees to +180 degrees (e.g, omnidirectional) as illustrated in the signal contour block 300 of FIG. 6 (e.g., see axis 302 of FIG. 6). The left and/or the right loudspeaker assemblies 102*a* and 102*b* transmit the audio signal within a frequency range (or a predetermined frequency range) of 250 Hz to roughly 1.5 kHz (see axis 304 of FIG. 6). Axis 306 as provided in FIG. 6 corresponds to the attenuation of the signal at various decibel levels. The stimulus signal has a bandwidth from 250 Hz to roughly 1.5 kHz such that the loudspeaker assemblies 102*a*, 102*b* play back audio at this frequency range. The stimulus signal includes a bandwidth from 250 Hz to 1.5 kHz to enable the left or right loudspeaker assemblies 102*a* and 102*b* to control directivity at this frequency range with high performance. Placing the audio source 101 proximate to the either the left or right loudspeaker assemblies 102*a*, 102*b* calibrates the system latency and the distance between such loudspeaker assemblies 102*a*, 102*b*. For example, the audio source 101 performs a time of flight calculation to determine the distance between the left or right loudspeaker assemblies 102*a*, 102*b*.

Figure 7:
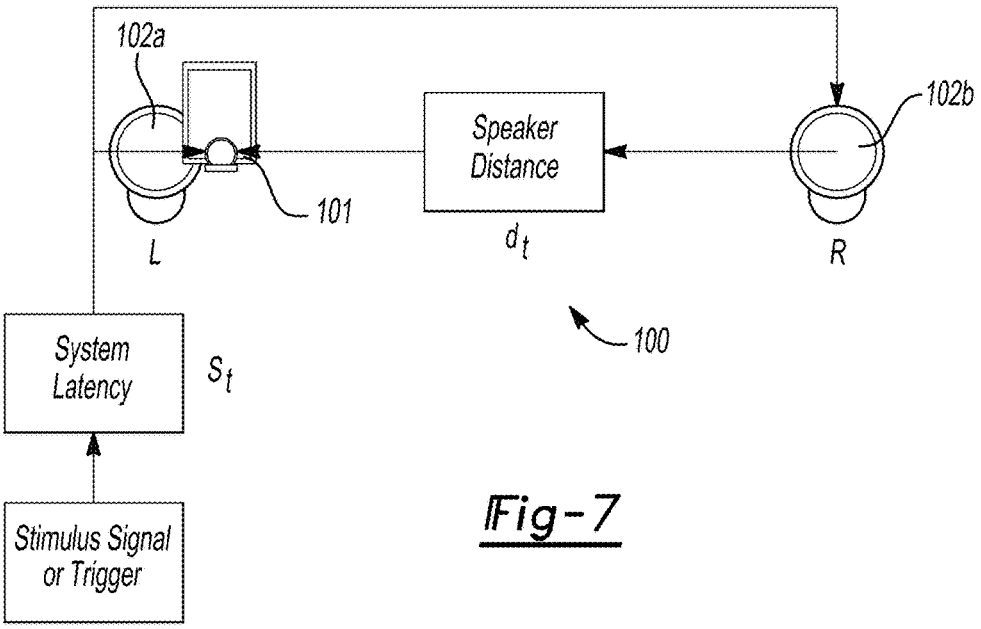
FIG. 7 generally depicts the audio system with a corresponding system latency associated with a stimulus signal in accordance to one embodiment.
Figure 8:
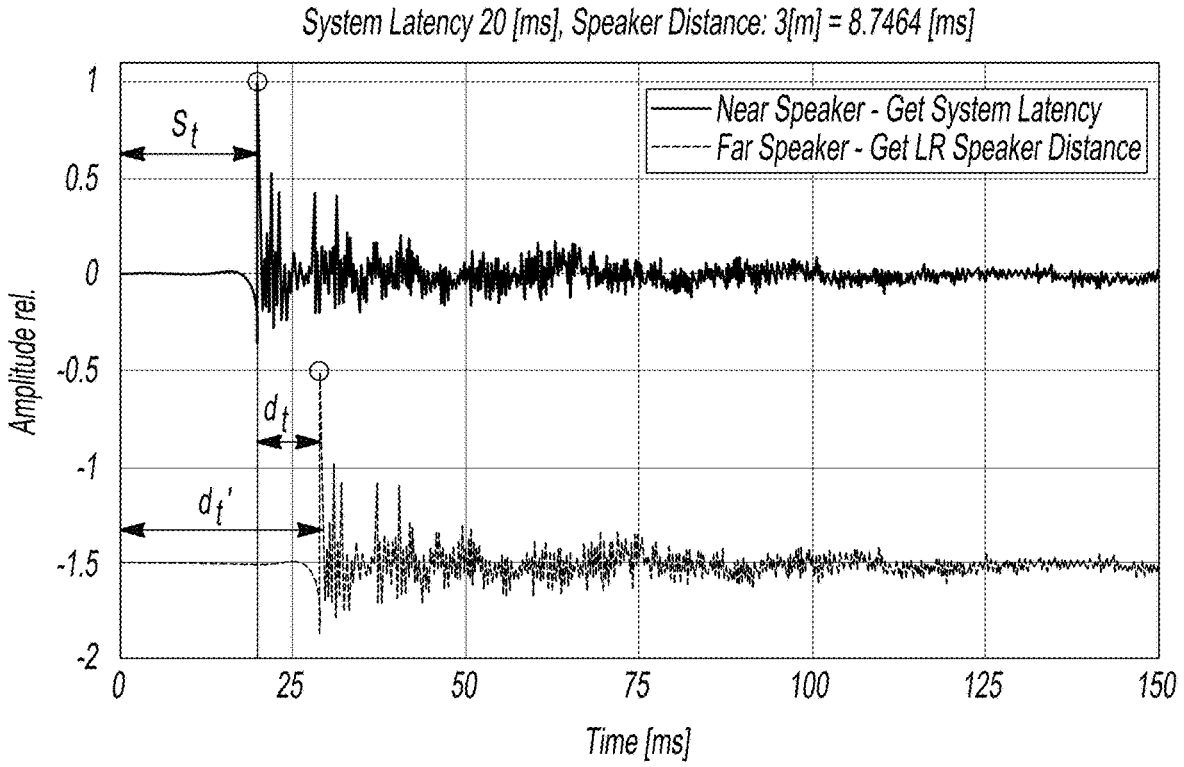
FIG. 8 generally depicts a corresponding system latency, distance between first and second loudspeaker assemblies, and time of flight of the stimulus signal in accordance to one embodiment.

FIG. 7 depicts the system 100 including a distance between the left loudspeaker assembly 102*a* and the right loudspeaker assembly 102*b*. A system latency, $s_t$ is shown in connection with the stimulus signal. In one example, the system latency $s_t$ may be 30 msec. FIGS. 7 and 8 provide additional information with respect to the manner in which the distance is determined.

From FIGS. 7 and 8, the following may be defined as:

$s_t$=system latency;

$d_t$=Speaker distance (Time of Flight) (sec);

d=Loudspeaker distance (m);

c=Speed of sound (i.e., 343 m/s), where dt' (i.e., the time of flight) and d (i.e., distance of the loudspeakers (or distance between the loudspeakers)) can be found through the following equations, respectively:

$$d_t = d'_t - s_t \quad \text{Eq. (1)}$$

$$d = d_t * c \quad \text{Eq. (2)}$$

Figure 9:
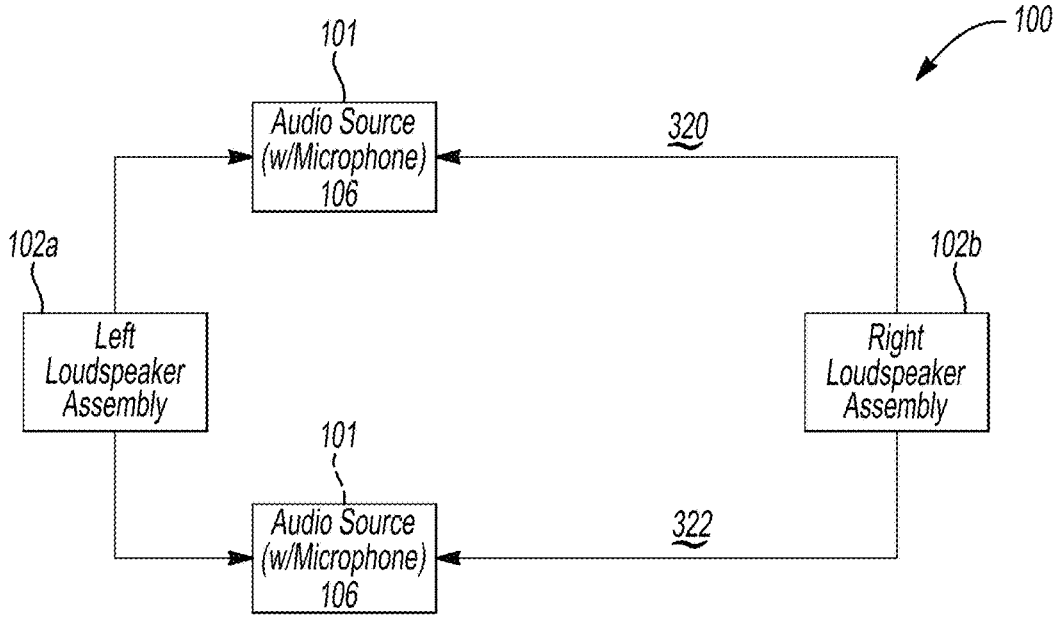
FIG. 9 generally depicts a second aspect that is performed by the audio system to perform the sweet spot calibration for the beamforming loudspeaker system in accordance to one embodiment.

FIG. 9 generally depicts a second aspect that is performed by the audio system 100 to perform the sweet spot calibration for the beamforming loudspeaker system 102 in accordance to one embodiment. In the second aspect, the audio source 101 transmits a second stimulus signal that may be omnidirectional to determine the distance for each loudspeaker assembly 102*a*, 102*b* relative to the audio source 101. However, an ambiguity arises in that the location (e.g., angle) for each loudspeaker assembly 102*a*, 102*b* may not be known. Once the audio source 101 determines the distance to the left and/or right loudspeaker assemblies 102*a*, 102*b* as noted above in connection with FIG. 5, the audio source 101 is required to resolve an ambiguity with respect to the position of the left and/or right loudspeaker assemblies 102*a*, 102*b* in relation to the audio source 101. For example, while the audio source 101 can determine the distance to the left and/or right loudspeaker assemblies 102*a*, 102*b*; it is not known whether the left and/or right loudspeaker assemblies 102*a*, 102*b* are positioned in front of the audio source 101 or positioned behind (or rearward) the audio source 101. A distance between the audio source 101 and the left loudspeaker assembly 102*a* is generally defined by the variable, L and a distance between the audio source 101 and the right loudspeaker assembly 102*b* is generally defined by the variable, R. The relevance of L and R will be discussed in more detail in connection with FIG. 10.

The aspect illustrated in FIG. 9 is not intended to illustrate that two audio sources 101 are actually present in the system 100. Rather, FIG. 9 illustrates that the audio source 101 is positioned at location 320 that may be in front of the left and right loudspeaker assemblies 102*a*, 102*b* or that the audio source 101 may be positioned at location 322 may be positioned behind, or rearward of the left and right loudspeaker assemblies 102*a*, 102*b*. In this case, there is an ambiguity that needs to be resolved. Thus, depending on the position of the left and right loudspeaker assemblies 102*a*, 102*b*; the sweet spot can be positioned in front of the left and/or right loudspeaker assemblies 102*a*, 102*b* or behind (or rearward) of the left and/or right loudspeaker assemblies 102*a*, 102*b*.

To resolve this ambiguity, the audio source 101 transmits the stimulus signal to the left and right loudspeaker assemblies 102*a*, 102*b*. In response to the stimulus signal, the left and right loudspeaker assemblies 102*a*, 102*b* transmit an audio output with directivity (e.g., not as an omni-directional beam as transmitted in connection with FIG. 5) in accordance to beamforming principles in a single direction to the audio source 101. For example, the audio source 101 transmits a separate control signal (that is different from the stimulus signal) that instructs the loudspeaker to transmit the audio output at a directivity field (not the omnidirectional field as discussed above in connection with FIGS. 4 and 6). The control signal as transmitted by the audio source 101 to the left and right loudspeaker assemblies 102*a*, 102*b* also provides a corresponding angle (e.g., α—for the left loudspeaker assembly 102*a* and 3 for the right loudspeaker assembly 102*b*) for the left and right loudspeaker assemblies 102*a*, 102*b* to transmit audio output signal to resolve the ambiguity. Prior to providing the control signal with the corresponding angles α, β it is necessary to determine these angles α, β. This aspect will be discussed in more detail in connection with FIG. 10.

Figure 10:
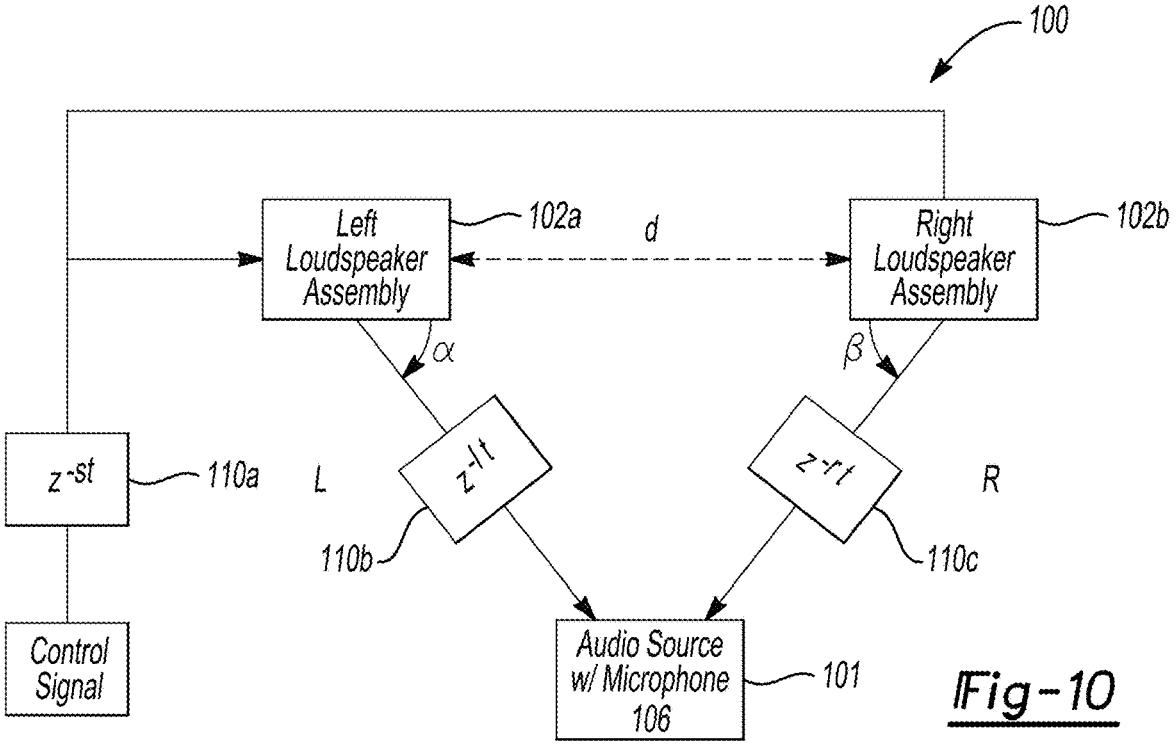
FIG. 10 generally depicts an example as to the manner in which the audio source determines angles for left and right loudspeaker assemblies in accordance to one embodiment.

FIG. 10 depicts an example as to the manner in which the audio source 101 determines angles α and β for the left and right loudspeaker assemblies 102*a*, 102*b*, respectively. In addition, the audio source 101 determines the distance, L between the audio source 101 and the left loudspeaker assembly 102*a* and the distance, R between the audio source 101 and the right loudspeaker assembly 102*b*. These aspects will be discussed in more detail below. The system 100 as illustrated in connection with FIG. 10 provides a plurality of delay blocks 110*a*-110*c*. The delay block 110*a* generally corresponds to a signal delay (or delay latency) associated with the transmission of the control signal from the audio source 101 to the left and right loudspeaker assemblies 102*a*, 102*b*. The delay block 110*b* generally corresponds to a signal delay associated with the transmission of the audio output signal from the left loudspeaker assembly 102*a* to the microphone 106 of the audio source 101 (e.g., acoustic delay of the left loudspeaker assembly 102*a*). The delay block 110*c* generally corresponds to a signal delay associated with the transmission of the audio output signal from the right loudspeaker assembly 102*b* to the microphone 106 of the audio source 101 (e.g., acoustic delay of the left loudspeaker assembly 102*a*).

As noted above, the audio source 101 determines the distance, d between the left and the right loudspeaker assemblies 102*a* and 102*b* as noted above in connection with Eq. 2 above. respectively, in addition to the distance, L between the audio source 101 and the left loudspeaker assembly 102*a* and the distance, R between the audio source 101 and the right loudspeaker assembly 102*b*, the audio source 101 utilizes the distances d, L, and R to determine the corresponding angles α and β. The audio source 101 transmits a stimulus signal to the left and right loudspeaker assemblies 102*a*, 102*b* such that these assemblies 102*a*, 102*b* transmit audio output signals in an omnidirectional range as similarly noted in connection with FIGS. 5 and 6 above.

Figure 11A:
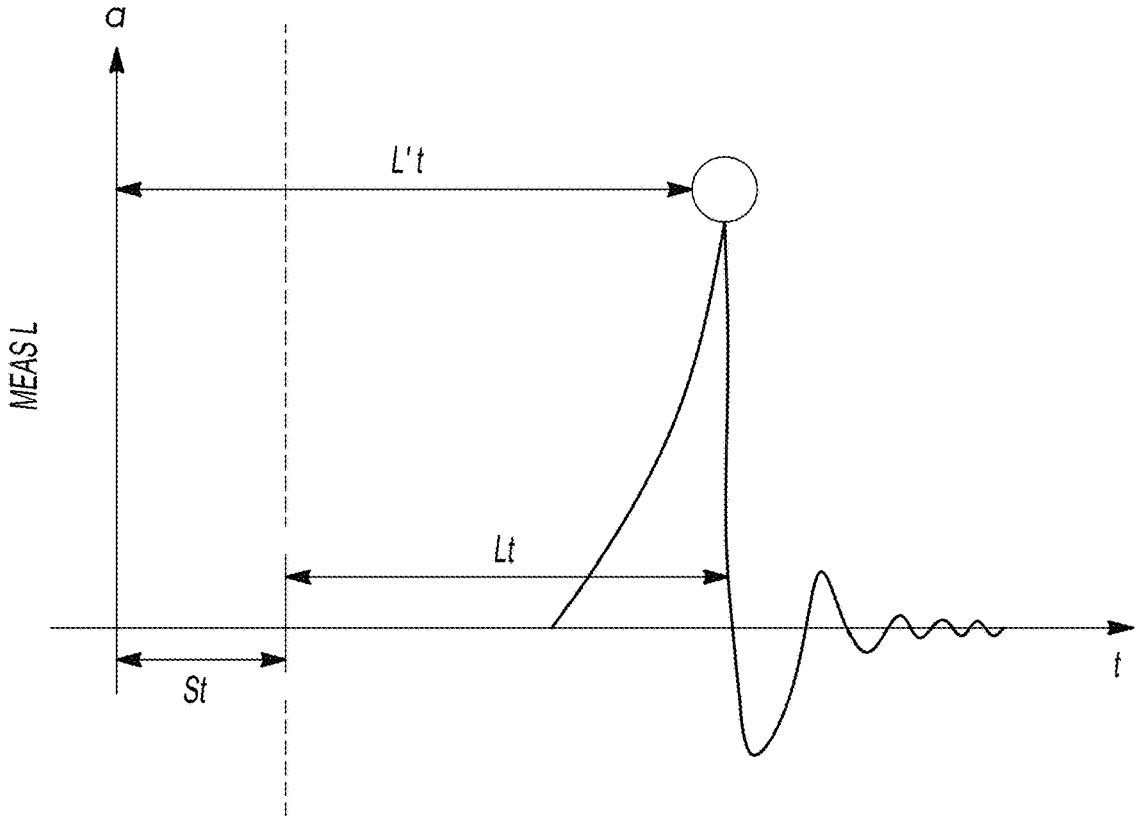
FIGS. 11A-11B generally depict peak amplitudes and measurements thereof for the left loudspeaker assembly and the right loudspeaker assembly in accordance to one embodiment in accordance to one embodiment.

FIG. 11A depicts an example of a measurement performed by the audio source 101 with respect to the audio output from the left loudspeaker assembly 102*a*. In general, the audio source 101 determines a peak amplitude L't of the audio output from the left loudspeaker assembly 102*a*, wherein the peak amplitude $L'_t$ corresponds to a length of time that it takes for the audio output from the left loudspeaker assembly 102*a* to reach a peak value. The audio source 101 determines the time of flight, $l_t$ with respect to the audio output from the left loudspeaker assembly 102*a*. The audio source 101 determines the time of flight, $L_t$ with respect to the audio output from the left loudspeaker assembly 102*a* and also determines the distance between the audio source 101 and the left loudspeaker assembly 102*a* with the following:

$$L_t = L'_t - s_t \quad \text{(Eq. 3)}$$

$$L = L_t * c[m] \quad \text{(Eq. 4)}$$

Figure 11B:
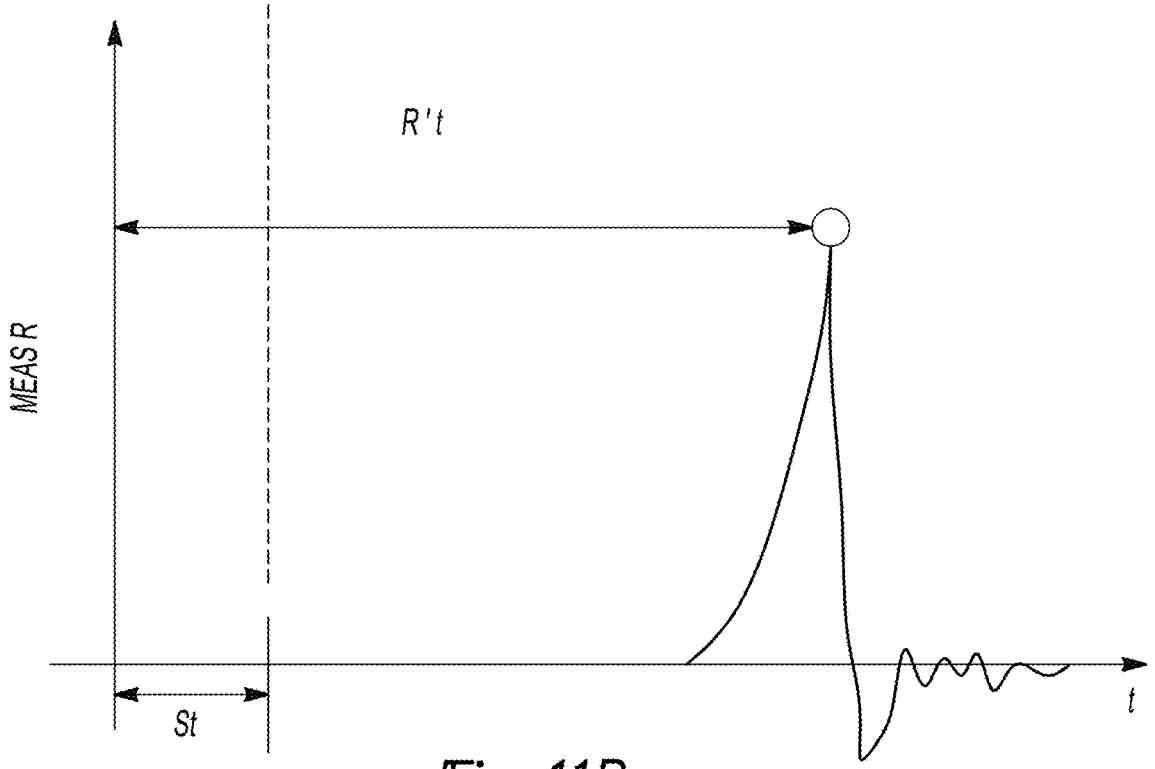

FIG. 11B depicts an example of a measurement performed by the audio source 101 with respect to the audio output from the right loudspeaker assembly 102*b*. In general, the audio source 101 determines a peak amplitude $R'_t$ of the audio output from the right loudspeaker assembly 102*b*, wherein the peak amplitude $R'_t$ corresponds to a length of time that it takes for the audio output from the right loudspeaker assembly 102*b* to reach a peak value. The audio source 101 determines the time of flight, $R_t$ with respect to the audio output from the right loudspeaker assembly 102*b* and also determines the distance between the audio source 101 and the right loudspeaker assembly 102*b* with the following:

$$R_t = R'_t - s_t \quad \text{(Eq. 5)}$$

$$R = R_t * c[m] \quad \text{(Eq. 6)}$$

With L, R, and d being known, the audio source 101 may utilize the following equation to determine the angles α and β:

$$\alpha = a\cos(L^2 + d^2 - R^2)/2Ld \quad \text{Eq. (7)}$$

$$\beta = a\cos(R^2 + d^2 - L^2)/2Rd \quad \text{Eq. (8)}$$

As noted above, the audio source 101 includes information corresponding to the angles α and β on the control signal as transmitted to the left and right loudspeaker assemblies 102*a*, 102*b* such that the left and right loudspeaker assemblies 102*a*, 102*b* transmit audio data in a field that is directive (e.g., narrow audio field that is not omnidirectional) at these corresponding angles α and β, respectively.

The audio source 101 determines which of the audio data as received from the left loudspeaker assembly 102*a* and the right loudspeaker assembly 102*b* is the loudest in order to remove the ambiguity as noted above. This aspect will be discussed in more detail below.

Figure 12:
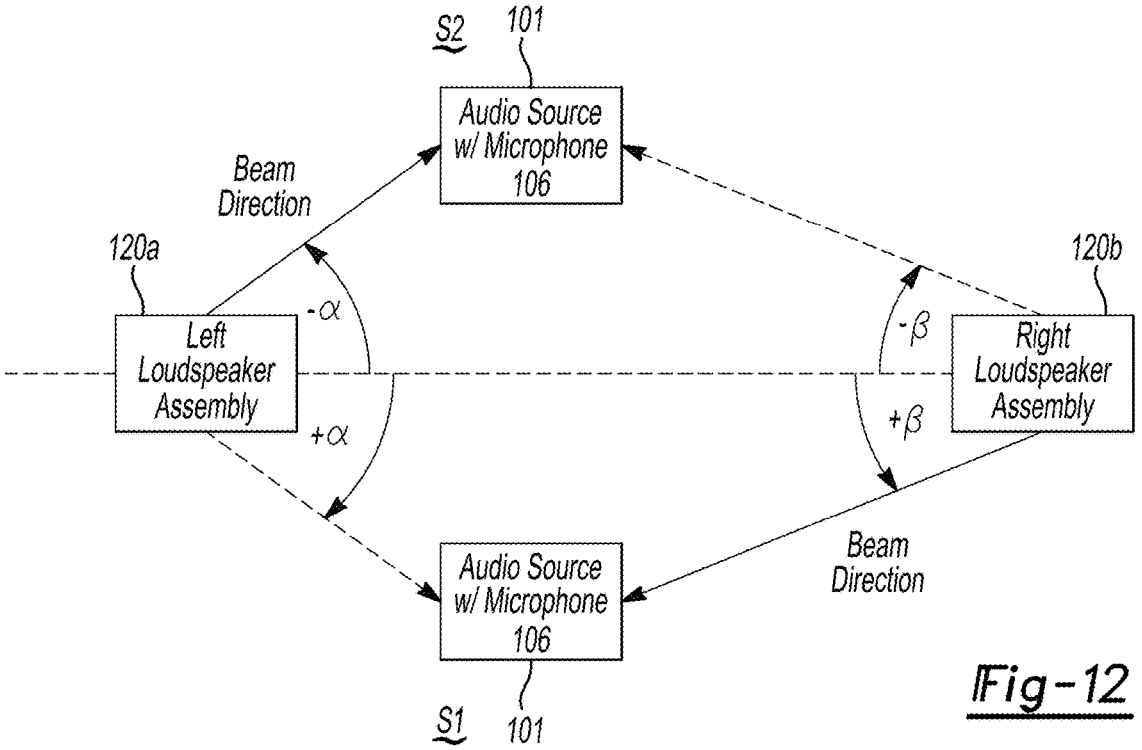
FIG. 12 generally depicts one example of the manner in which an ambiguity of the audio system is resolved and the manner in which the system determines the sweet spot in accordance to a third aspect.

FIG. 12 generally depicts one example of the manner in which the ambiguity of the system 100 is resolved and the manner in which the system 100 determines the sweet spot (S1 or S2) for the listener 104 in accordance to a third aspect. As noted above, once the audio source 101 determines the corresponding angles (e.g., α—for the left loudspeaker assembly 102*a* and β for the right loudspeaker assembly 102*b*), the audio source 101 transmits information corresponding to the angle α and β to the left and the right loudspeaker assemblies 102*a* and 102*b*, respectively. FIG. 12 depicts two corresponding angles (e.g., $\alpha_1$, $\alpha_2$) where only information to one of these angles may be transmitted on the control signal for the left loudspeaker assembly 102*a* to transmit the audio output signal to determine the sweet spot location. It is recognized that at or $\alpha_2$ may be positive or negative. For example, angle $\alpha_1$ can be defined as −α and angle $\alpha_2$ can be defined as defined as +α. Likewise, it is recognized that $\beta_1$ or $\beta_2$ may be positive or negative. For example, angle $\beta_1$ can be defined as −β and angle $\beta_2$ can be defined as defined as +β.

In the example illustrated in FIG. 12, two audio sources 101 are provided for purposes of illustration. However, in implementation, only one of these audio sources 101 may actually be provided. In general, it is not known where the audio source 101 is located in reference to the left and the right loudspeaker assemblies 102*a* and 102*b* which is the reason for illustrating two audio sources 101. In general, the audio source 101 provides a control signal with information corresponding to the angle −α to the left loudspeaker assembly 102*a* (with directivity) and the audio source 101 provides the control signal with information corresponding to the angle +β to the right loudspeaker assembly 102*b* (e.g., the angles $-\alpha_1$ and +Jβ are determined based on equations 7 and 8 as noted above). Thus, the left loudspeaker assembly 102*a* transmits the audio output signal toward the sweet spot S2 and the right loudspeaker assembly 102*b* transmits the audio output signal toward the sweet spot S1. At this point, it is not known where the actual sweet spot is only that the sweet spot may correspond to S1 or S2 locations.

Figure 13A:
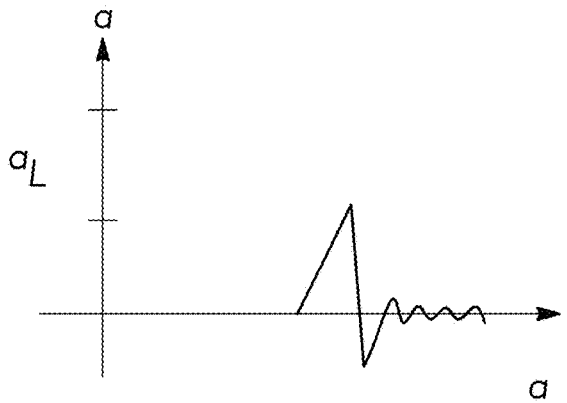
FIGS. 13A-13B generally depict peak amplitudes and measurements thereof for the left loudspeaker assembly and the right loudspeaker assembly in accordance to one embodiment.
Figure 13B:
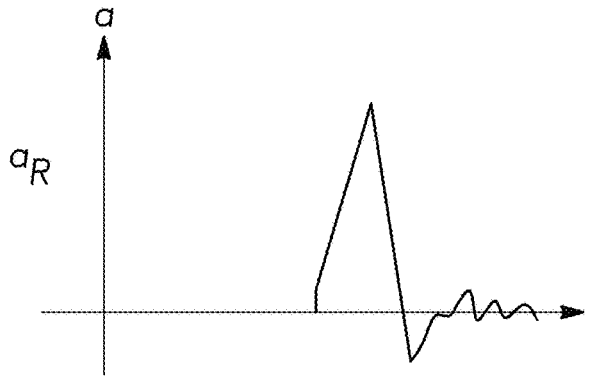

The audio source 101 performs a measurement of the peak amplitude of the audio output signal as received from the left loudspeaker assembly 102*a* and the right loudspeaker assembly 102*b* in response to such assemblies 102*a* and 102*b* transmitting the audio output signals at the angles −α, +β; respectively. FIGS. 13A and 13B generally illustrate the peak amplitude of the audio output from the left loudspeaker assembly 102*a* and the right loudspeaker assembly 102*b*. In this case, the audio source 101 determines which peak amplitude of the audio output signal from the right loudspeaker assembly 102*b* (i.e., $a_R$) is the loudest (e.g., see FIG. 13B).

In general, if $a_R$ (e.g., the measured peak amplitude) of the audio output from the left loudspeaker assembly 102*b* is greater than the $a_L$ (e.g., the measured peak amplitude output from the left loudspeaker assembly 102*a*), then the sweet spot is determined to be at location S1. FIGS. 13*a* and 13*b* corresponds to this condition and S1 is determined to be the sweet spot since the peak amplitude of $a_R$ is greater than the measured peak amplitude of $a_L$. In this case, the audio source 101 is located in the bottom of FIG. 12 (or in front of the left and right loudspeaker assemblies 102*a*-102*b*). Once the audio source 101 determines that the location of the sweet spot is at S1, then audio source 101 then transmits another control signal such that the left loudspeaker assembly 102*a* transmits the audio output at an angle +α (note that this is the opposite of angle −α—which was used to determine the location of the sweet spot S1 and noted directly above) and the right loudspeaker assembly 102*b* continues to transmit the audio output at the angle +β such that the audio output from each of the left loudspeaker assembly 102*a* and the right loudspeaker assembly 102*b* is directed to the sweet spot S1.

Alternatively, if $a_L$ (e.g., the measured peak amplitude) of the audio output from the left loudspeaker assembly 102*a* is greater than the $a_R$ (e.g., the measured peak amplitude output from the left loudspeaker assembly 102*b*), then the sweet spot is determined to be at location S2. In this case, the audio source 101 is located at the top of FIG. 12 (or behind the left and right loudspeaker assemblies 102*a*-102*b*). Once the audio source 101 determines that the location of the sweet spot is at S2, then audio source 101 then transmits another control signal such that the left loudspeaker assembly 102*a* continues to transmit the audio output at an angle −α and the right loudspeaker assembly 102*b* transmits the audio output at the angle −β ((note that this is the opposite of angle +β)) which was used to determine the location of the sweet spot S1 and noted directly above) such that the audio output from each of the left loudspeaker assembly 102*a* and the right loudspeaker assembly 102*b* is directed to the sweet spot S2.

Figure 14:
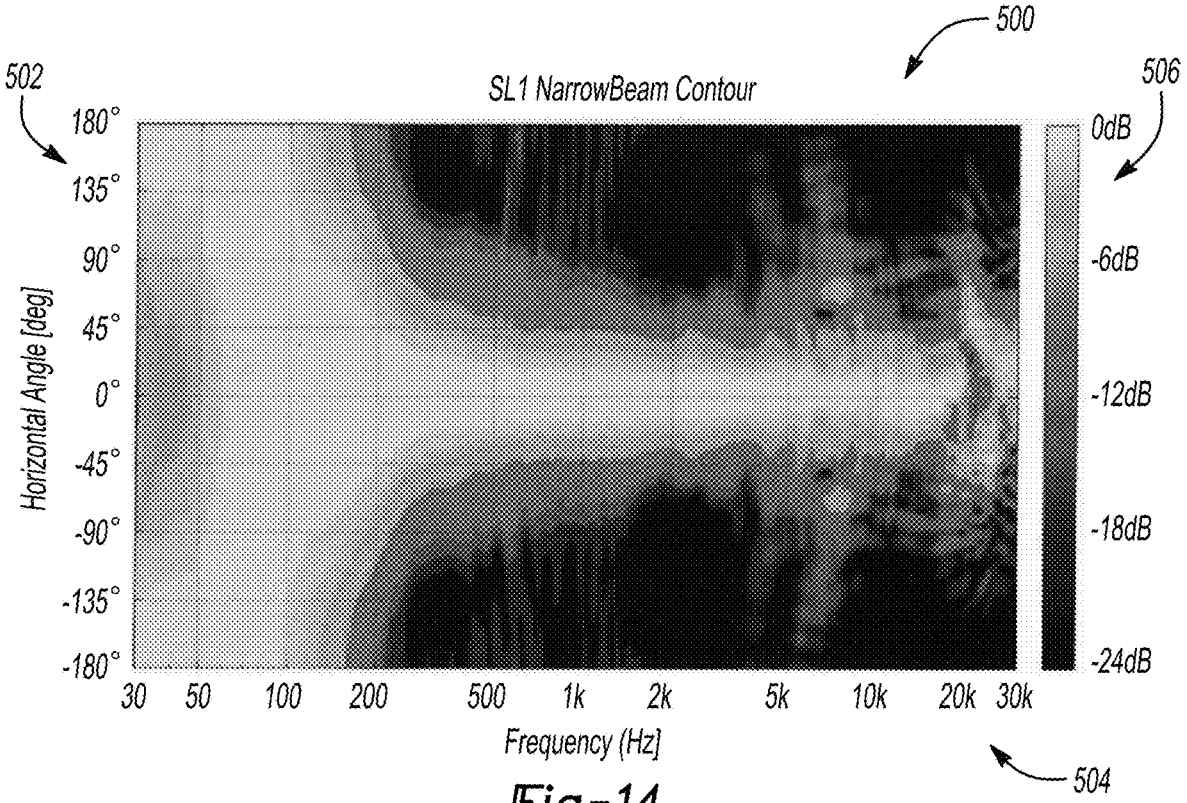
FIG. 14 generally depicts a signal contour for an output of the left or right beamforming loudspeaker assemblies in connection with the third aspect as set forth in FIG. 12.

FIG. 14 generally depicts a signal contour 500 for an output of the left or right beamforming loudspeaker assemblies 102*a*, 102*b* in connection with the third aspect as set forth in FIG. 12. For the aspect illustrated in connection with FIG. 8, the left or right loudspeaker assembly 102*a*, 102*b* transmits the audio output with a small horizontal angle that spans from −50 degrees to +50 degrees as illustrated in the signal contour block 300 of FIG. 9 (e.g., see axis 502 of FIG. 6). The left and/or the right loudspeaker assemblies 102*a* and 102*b* transmit the audio signal within a frequency range of 250 Hz to roughly 1.5 kHz (see axis 504 of FIG. 9). In this case, the frequency is controlled so that the audio output (e.g., from the left and or right loudspeaker assemblies 102*a*, 102*b*) is properly received at the audio source 101 to determine the loudness of the left and right loudspeaker assemblies 102*a*, 102*b*. By controlling the directivity (e.g., omni directional or beamforming with narrow beam) within this frequency range (e.g., 250 Hz to 1.5 KHz) it is possible to detect amplitude differences with the beamforming). In general, the audio output signals from the left and the right loudspeaker assemblies 102*a*, 102*b* is of narrow directivity (e.g., not omnidirectional) and is within the noted frequency range. These aspects yield advantageous results in that the directivity and frequency is well controlled and measurement tones of the audio output signals are not very high in frequency which could be disturbing to the listener.

Figure 15:
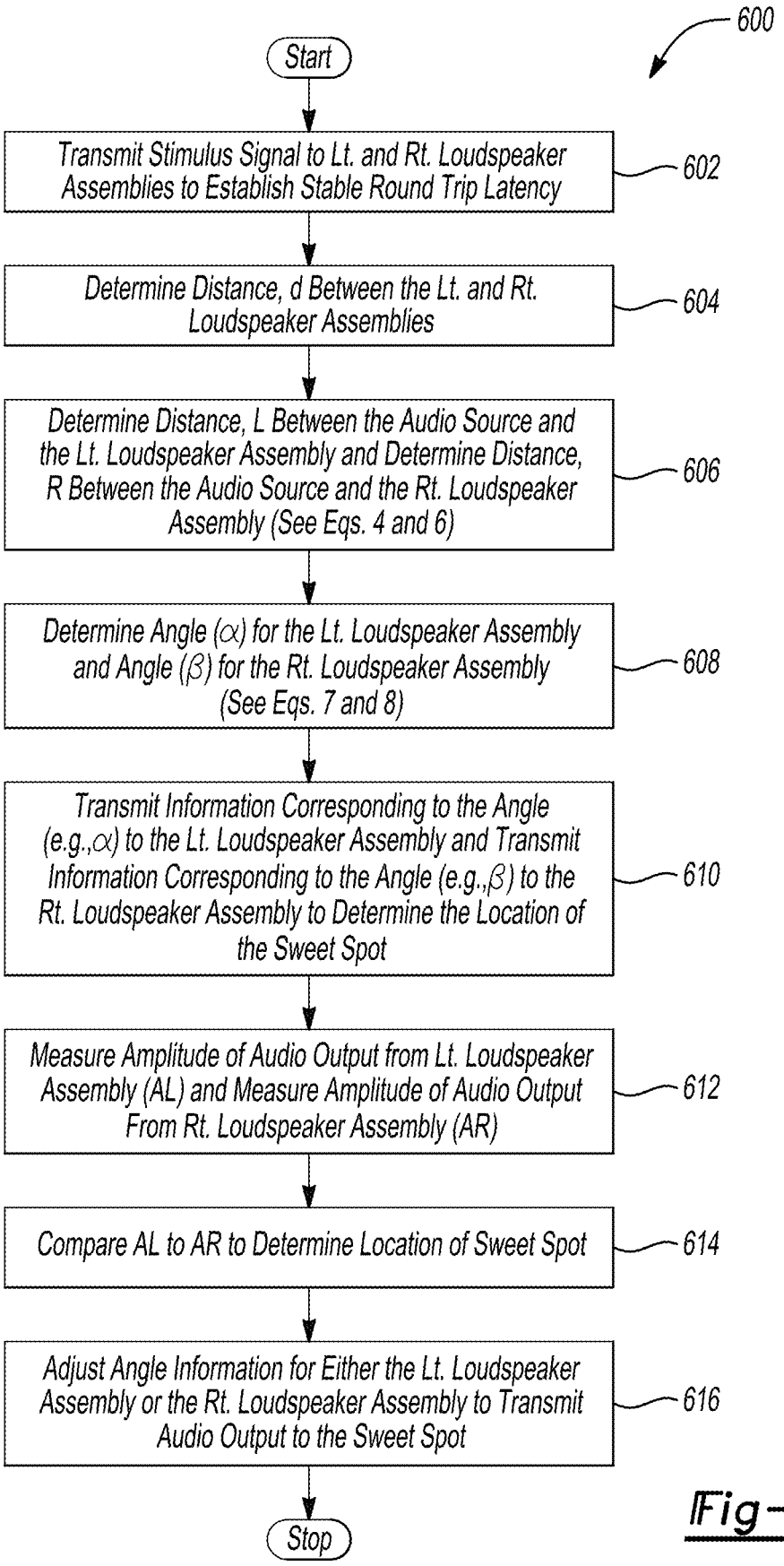
FIG. 15 generally depicts a method performing a sweet spot calibration for a beamforming loudspeaker system in accordance to one embodiment.

FIG. 15 depicts a method 600 for performing sweet spot calibration for a beamforming loudspeaker system in accordance to one embodiment.

In operation 602, the audio source 101 transmits a stimulus signal to the left loudspeaker assembly 102*a* and to the right loudspeaker assembly 102*b* to establish a stable round trip latency (e.g., $s_t$). As noted above, the jitter associated with the round-trip latency must be stable and the jitter should be between +/−145 microseconds which generally equals 7 samples of audio on the audio output @48 kHz as provided by the left and the right loudspeaker assemblies 102*a* and 102*b*. For example, the stable round-trip latency may be 30 msec. This aspect is described in more detail in connection with FIG. 4 above.

In operation 604, the audio source 101 determines the distance, d between the left and the right loudspeaker assemblies 102*a*, 102*b*. As noted above in connection with FIG. 7, the audio source 101 determines the speaker distance or the time of flight (e.g., $d_t$) that corresponds to the distance and calculates distance d based on Eq. (2) as set forth above.

In operation 606, the audio source 101 determines the distance, L between the audio source 101 and the left loudspeaker assembly 102*a*. The audio source 101 also determines the distance, R between the audio source 101 and the right loudspeaker assembly based on Eqs. 4 and 6 as noted above.

In operation 608, the audio source 101 determines the angle, α for the left loudspeaker assembly and the angle, β for the right loudspeaker assembly based on Eqs. 7 and 8 as noted above.

In operation 610, the audio source 101 transmits information corresponding to the angle (e.g., α) to the left loudspeaker assembly 102*a* and transmits information corresponding to the angle (e.g., β) to the right loudspeaker assembly 102*b* to determine the location of the sweet spot.

In operation 612, the audio source 101 measures an amplitude of the audio output from the left loudspeaker assembly 102*a* (e.g., $a_L$) and measures an amplitude of the audio output from the right loudspeaker assembly (e.g, $a_R$).

In operation 614, the audio source 101 compares $a_L$ to $a_R$ to determine the location of the sweet spot. As noted above, the sweet spot generally corresponds to a location or a position in which the audio output from the left loudspeaker assembly 102*a* and the right loudspeaker assembly 102*b* is perceived by a listener as having a similar loudness and a similar acoustic delay.

In operation 616, the audio source 101 adjusts angle information for either the left loudspeaker assembly 102*a* or the right loudspeaker assembly 102*b* to transmit the audio output to the location of the sweet spot as noted in connection with FIG. 12 above.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for determining a location for a beamforming loudspeaker system to transmit an audio output thereto, the system comprising:

a memory device; and an audio source including the memory device and being configured to:

transmit a first stimulus signal to one of a first beamforming loudspeaker assembly and a second beamforming loudspeaker assembly to play back an audio output;

receive the audio output from the one of the first beamforming loudspeaker assembly and the second beamforming loudspeaker assembly;

determine a first distance between a first beamforming loudspeaker assembly and a second beamforming loudspeaker assembly;

determine a second distance between the audio source and the first beamforming loudspeaker assembly;

determine a third distance between the audio source and the second beamforming loudspeaker assembly;

determine a location for transmitting the audio output from each of the first beamforming loudspeaker assembly and the second beamforming loudspeaker assembly based at least on the first distance, the second distance, and the third distance; and determine a first angle for the first beamforming loudspeaker assembly to transmit the audio output therefrom based at least on the first distance, the second distance, and the third distance prior to determining the location for the audio output.

2. The system of claim 1, wherein the audio source is further configured to transmit the first angle on a control signal to the first beamforming loudspeaker assembly to transmit the audio output at a narrow directivity field in accordance to the first angle and within a first predetermined frequency range.

3. The system of claim 2, wherein the first predetermined frequency range is within 250 to 1.5 KHz.

4. The system of claim 1, wherein the audio source is further configured to determine a second angle for the second beamforming loudspeaker assembly to transmit the audio output therefrom based at least on the first distance, the second distance, and the third distance prior to determining the location for the audio output.

5. The system of claim 4, wherein the audio source is further configured to transmit the second angle on a control signal to the second beamforming loudspeaker assembly to transmit the audio output at a narrow directivity field in accordance to the second angle and within a predetermined frequency range.

6. The system of claim 5, wherein the predetermined frequency range is within 250 to 1.5 KHz.

7. The system of claim 4, wherein the audio source is further configured to measure a first peak amplitude of the audio output from the first beamforming loudspeaker assembly after the first beamforming loudspeaker assembly transmits the audio output at the first angle.

8. The system of claim 7, wherein the audio source is further configured to measure a second peak amplitude of the audio output from the second beamforming loudspeaker assembly after the second beamforming loudspeaker assembly transmits the audio output at the second angle.

9. The system of claim 8, wherein the audio source compares the first peak amplitude to the second peak amplitude to determine the location for transmitting the audio output from each of the first beamforming loudspeaker assembly and the second beamforming loudspeaker assembly.

10. The system of claim 1, wherein the location corresponds to a position in which the audio output from the first beamforming loudspeaker assembly and the second beamforming loudspeaker assembly is perceived by a listener as having a similar loudness and acoustic delay.

11. A computer-program product embodied in a non-transitory computer readable medium that is programmed to determine a location for a beamforming loudspeaker system to transmit an audio output thereto, the computer-program product comprising instructions to:

transmit a first stimulus signal to one of a first beamforming loudspeaker assembly and a second beamforming loudspeaker assembly to play back an audio output;

receive the audio output from the one of the first beamforming loudspeaker assembly and the second beamforming loudspeaker assembly;

determine a first distance between a first beamforming loudspeaker assembly and a second beamforming loudspeaker assembly;

determine a second distance between the audio source and the first beamforming loudspeaker assembly;

determine a third distance between the audio source and the second beamforming loudspeaker assembly;

determine a location for transmitting the audio output from each of the first beamforming loudspeaker assembly and the second beamforming loudspeaker assembly based at least on the first distance, the second distance, and the third distance; and determine a first angle for the first beamforming loudspeaker assembly to transmit the audio output therefrom based at least on the first distance, the second distance, and the third distance prior to determining the location for the audio output.

12. The computer-program product of claim 11 further comprising instructions to transmit the first angle on a control signal to the first beamforming loudspeaker assembly to transmit the audio output at a narrow directivity field in accordance to the first angle and within a first predetermined frequency range.

13. The computer-program product of claim 12 further comprising instructions to determine a second angle for the second beamforming loudspeaker assembly to transmit the audio output therefrom based at least on the first distance, the second distance, and the third distance prior to determining the location for the audio output.

14. The computer-program product of claim 13 further comprising instructions to transmit the second angle on a control signal to the second beamforming loudspeaker assembly to transmit the audio output at a narrow directivity field in accordance to the second angle and within a predetermined frequency range.

15. The computer-program product of claim 13 further comprising instructions to measure a first peak amplitude of the audio output from the first beamforming loudspeaker assembly after the first beamforming loudspeaker assembly transmits the audio output at the first angle.

16. The computer-program product of claim 15 further comprising instructions to measure a second peak amplitude of the audio output from the second beamforming loudspeaker assembly after the second beamforming loudspeaker assembly transmits the audio output at the second angle.

17. The computer-program product of claim 16 further comprising instructions to compare the first peak amplitude to the second peak amplitude to determine the location for transmitting the audio output from each of the first beamforming loudspeaker assembly and the second beamforming loudspeaker assembly.

18. A method for determining a location for a beamforming loudspeaker system to transmit an audio output thereto, the method comprising:

receiving an audio output from one a first beamforming loudspeaker assembly and a second beamforming loudspeaker assembly;

determining a first distance between the first beamforming loudspeaker assembly and the second beamforming loudspeaker assembly;

determining a second distance between an audio source and the first beamforming loudspeaker assembly;

determining a third distance between the audio source and the second beamforming loudspeaker assembly;

determining a location for transmitting the audio output from each of the first beamforming loudspeaker assembly and the second beamforming loudspeaker assembly based at least on the first distance, the second distance, and the third distance, and determining a first angle for the first beamforming loudspeaker assembly to transmit the audio output therefrom based at least on the first distance, the second distance, and the third distance prior to determining the location for the audio output, wherein the location corresponds to a position in which the audio output from the first beamforming loudspeaker assembly and the second beamforming loudspeaker assembly is perceived by a listener as having a similar loudness and acoustic delay.

* * * * *